US005154259A

United States Patent [19]

Magome

[11] Patent Number: 5,154,259

[45] Date of Patent: Oct. 13, 1992

[54] LUBRICATING DEVICE FOR KNITTING MACHINE

[75] Inventor: Shigenao Magome, Souwa, Japan

[73] Assignee: Lube Corporation, Japan

[21] Appl. No.: 602,498

[22] Filed: Oct. 24, 1990

[30] Foreign Application Priority Data

Nov. 8, 1989 [JP] Japan ..... 1-288836

[51] Int. Cl.[5] ..... F16N 27/00

[52] U.S. Cl. ..... 184/7.4; 184/6.26; 184/39.1; 184/55.1; 66/8

[58] Field of Search ..... 184/55.2, 55.1, 6.15, 184/6.14, 7.4, 6.26, 41, 42, 45.1, 45.2, 39.1; 66/8, 168

[56] References Cited

U.S. PATENT DOCUMENTS

| | | | |
|---|---|---|---|
| 3,481,431 | 12/1969 | Dorsey | 66/8 |
| 3,756,348 | 9/1973 | Iizumi | 184/55.2 |
| 3,888,420 | 6/1975 | Boelkins | 184/7.4 |
| 4,332,309 | 6/1982 | Bereit | 184/7.4 |
| 4,345,668 | 8/1982 | Gaunt | 184/7.4 |
| 4,353,435 | 10/1982 | Abrams et al. | 184/55.2 |
| 4,951,785 | 8/1990 | Javelly et al. | 184/7.4 |
| 5,002,156 | 3/1991 | Gaunt | 184/7.4 |

FOREIGN PATENT DOCUMENTS

| | | |
|---|---|---|
| 1050137 | 2/1959 | Fed. Rep. of Germany . |
| 2004770 | 8/1971 | Fed. Rep. of Germany . |
| 2543913 | 4/1977 | Fed. Rep. of Germany . |
| 2638109 | 2/1978 | Fed. Rep. of Germany . |
| 3028125 | 2/1981 | Fed. Rep. of Germany . |

*Primary Examiner*—Ira S. Lazarus
*Assistant Examiner*—Alan B. Cariaso
*Attorney, Agent, or Firm*—Lerner, David, Littenberg, Krumholz & Mentlik

[57] ABSTRACT

A lubricating device for a knitting machine capable of feeding lubricating oil in proper quantities while eliminating the necessity of forming the oil into mist, to thereby accomplish a lubricating action with high efficiency without deteriorating the environment. The lubricating device includes oil/air mixing sections which are defined in a lubricating distributor so as to communicate with oil passages and air passages. The mixing sections each are adapted to mix lubricating oil fed thereto through the oil passage by means of an oil feed valve and compressed air fed thereto through the air passage by means of an air feed valve, resulting in the lubricating oil being fed to a lubricated section of the knitting machine while being carried on the compressed air.

16 Claims, 4 Drawing Sheets

LUBRICATING DEVICE FOR KNITTING MACHINE

BACKGROUND OF THE INVENTION

This invention relates to a lubricating device for a knitting machine such as a circular knitting machine or the like, and more particularly to a lubricating device for feeding a lubricated section of a knitting machine such as a cam track, a needle, a needle groove, a drive section of the knitting machine, its sliding surface section or the like with lubricating oil in proper quantities.

In general, a distributing valve which includes a metering and oil-accumulating mechanism and is adapted to feed lubricating oil in a predetermined amount in the form of droplets, particularly, spray is conventionally used for a centralized lubricating system which functions to continuously distribute a small amount of lubricating oil to a lubricated section of a knitting machine such as its sliding section, its drive section or the like.

Such a distributing valve is required to gradually feed lubricating oil in a predetermined amount from an oil source to the lubricated section. For this reason, a piston-type accumulator which is adapted to adjust the amount of oil accumulated therein is used as the distributing valve. Unfortunately, the accumulator causes a space to be remain in a cylinder chamber during the movement of a piston, so that the piston fails to fully discharge liquid from the cylinder. This leads to a disadvantage of failing to feed lubricating oil in a predetermined proper amount, resulting in a failure in lubrication.

In order to avoid such a problem, a system is proposed which continuously feeds lubricating oil in the form of droplets by forming oil gradually fed in a predetermined amount into mist by means of an oil mist unit arranged outside the distributing valve while using compressed air as a carrier medium.

However, the system of feeding lubricating oil in the form of mist or droplets causes fine oil particles to be scattered outside, to thereby deteriorate the environment. Thus, it is not suitable for use for a knitting machine or the like which manufactures a product easily damaged by oil. Also, it causes waste of oil sufficient to lead to economical loss.

SUMMARY OF THE INVENTION

The present invention has been made in view of the foregoing disadvantages of the prior art.

Accordingly, it is an object of the present invention to provide a lubricating device for a knitting machine which is capable of accomplishing lubrication with high efficiency and reliability.

It is another object of the present invention to provide a lubricating device for a knitting machine which is capable of feeding lubricating oil in proper quantities while eliminating the necessity of forming the oil into mist.

It is a further object of the present invention to provide a lubricating device for a knitting machine which is capable of permitting the knitting machine to be stably operated.

It is still another object of the present invention to provide a lubricating device for a knitting machine which is capable of deteriorating the environment.

It is yet another object of the present invention to provide a lubricating device for a knitting machine which is capable of significantly reducing maintenance of the lubricating device and knitting machine.

It is even another object of the present invention to provide a lubricating distributor for a lubricating device which is capable of feeding lubricating oil in proper quantities without requiring to form the oil into mist, to thereby accomplish a lubricating action with high efficiency.

It is a still further object of the present invention to provide a lubricating distributor for a lubricating device which is capable of being stably and positively operated.

It is a yet further of the present invention to provide a lubricating distributor for a lubricating device which is capable of deteriorating the environment.

It is an even further object of the present invention to provide a lubricating distributor for a lubricating device which is capable of significantly reducing the maintenance.

In accordance with the present invention, a lubricating device for a knitting machine is provided. The lubricating device includes a lubricating distributor to which lubricating oil and compressed air are fed from an oil pump and a compressed air source, respectively, and which feeds the lubricating oil to a lubricated section of the knitting machine. The lubricating distributor is provided therein with a mixing means for mixing the lubricating oil and compressed air therein to feed the lubricating oil to the lubricated section of the knitting machine while carrying the lubricating oil on the compressed air, an oil feed means for feeding the lubricating oil in a predetermined amount to the mixing means, and an air feed means for feeding the compressed air in a predetermined amount to the mixing means.

The oil feed means and air feed means may be constructed so as to adjust the flow rate of lubricating oil and that of compressed air, respectively.

Also, the oil feed means may be constructed so as to intermittently feed lubricating oil.

Also, in accordance with the present invention, a lubricating device for a knitting machine is provided. The lubricating device includes a lubricating distributor to which lubricating oil and compressed air are fed from an oil pump and a compressed air source, respectively, and which feeds the lubricating oil to a lubricated section of the knitting machine. In the lubricating distributor is arranged a mixing means for mixing the lubricating oil and compressed air therein to outwardly discharge the lubricating oil while carrying the lubricating oil on the compressed air. The lubricating distributor is provided therein with an oil passage means for flowing the lubricating oil therethrough, which is defined so as to communicate with the mixing means and includes an inlet means communicating with the oil pump and an outlet means. In the oil passage means is arranged an oil feed valve means for feeding the lubricating oil in a predetermined amount to the mixing means. Also, an air passage means is provided for flowing the compressed air therethrough, which is defined in the lubricating distributor so as to communicate with the mixing means. In the air passage means is provided an air feed valve means provided for feeding compressed air in a predetermined amount to the mixing means.

In a preferred embodiment of the present invention, the mixing means comprises an oil/air mixing section for mixing the compression air and lubricating oil therein, a throttle nozzle connected between the oil/air mixing section and the oil passage means for discharging the lubricating oil to the oil/air mixing section, a compressed air blowout section defined around the throttle nozzle and communicating with the air passage means and oil/air mixing section so as to forcedly discharge the compression air thereto and guide the compression air to the oil/air mixing section.

In a preferred embodiment of the present invention, the oil feed valve means comprises a hollow shaft formed with an axially extending through-hole, a piston fitted on the hollow shaft so as to be slidable in the axial direction thereof and an elastic check valve provided with a lip and functioning to operate the through-hole of the hollow shaft.

In accordance with another aspect of the present invention, a lubricating distributor for a lubricating device is provided. The lubricating distributor includes a mixing means for mixing lubricating oil and compressed air to outwardly discharge the lubricating oil while carrying the lubricating oil on the compressed air, an oil feed means for feeding the lubricating oil in a predetermined amount to the mixing means, and an air feed means for feeding the compressed air in a predetermined amount to the mixing means. The mixing means, oil feed means and air feed means are arranged in the lubricating distributor.

Further, in accordance with the present invention, a lubricating distributor for a lubricating device is provided. The lubricating distributor includes a mixing means arranged in the lubricating distributor for mixing the lubricating oil and compressed air to outwardly discharge the lubricating oil while carrying the lubricating oil on the compressed air. An oil passage means is provided for flowing the lubricating oil therethrough. The oil passage means is defined in the lubricating distributor so as to communicate with the mixing means and includes an inlet means communicating with the oil pump and an outlet means. In the oil passage means is provided an oil feed valve means for feeding the lubricating oil in a predetermined amount to the mixing means. Also, an air passage means is provided for flowing the compressed air therethrough. The air passage means is defined in the lubricating distributor so as to communicate with the mixing means, in which an air feed valve means is provided for feeding compressed air in a predetermined amount to the mixing means.

BRIEF DESCRIPTION OF THE DRAWINGS

These and other objects and many of the attendant advantages of the present invention will be appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Figure 1:
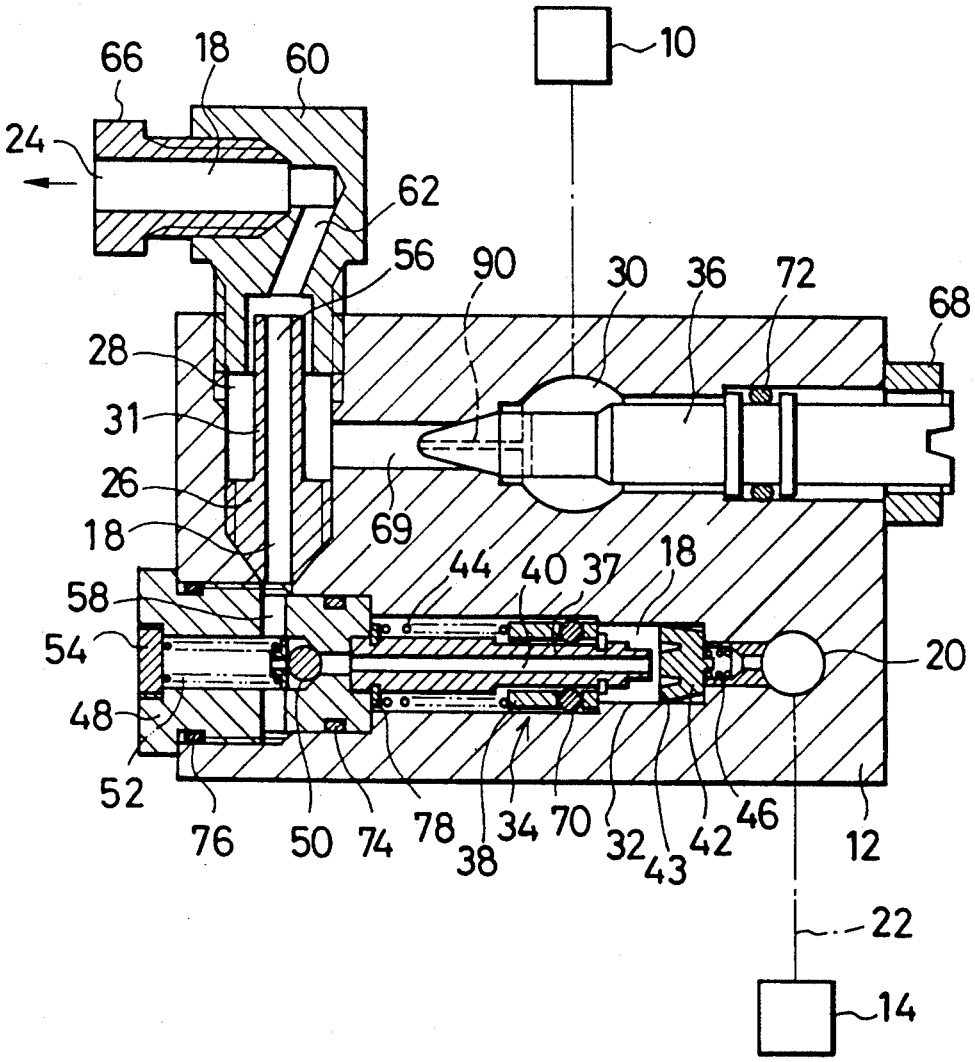
FIG. 1 is a vertical sectional view showing a lubricating distributor incorporated in an embodiment of a lubricating device for a knitting machine according to the present invention.
Figure 2:
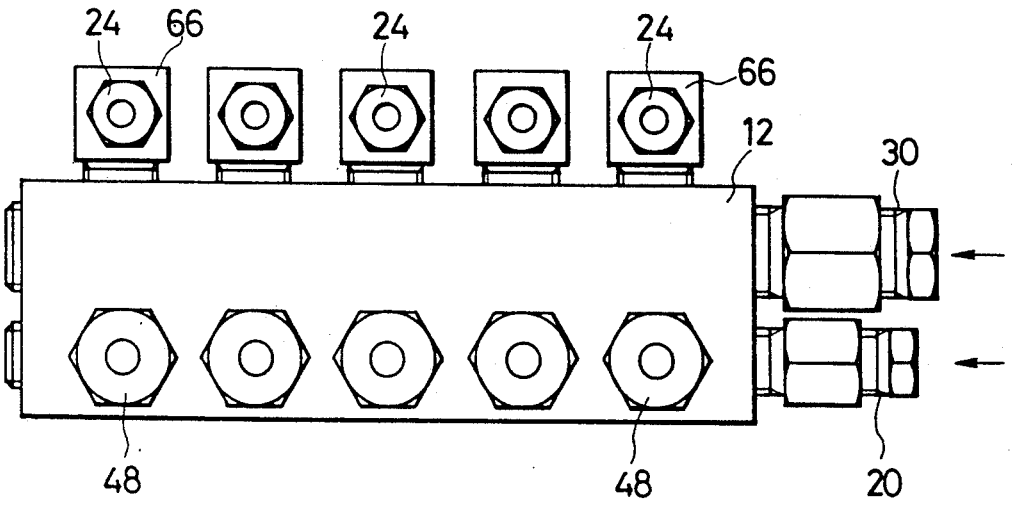
FIG. 2 is a front elevation view of the lubricating distributor shown in FIG. 1.
Figure 3:
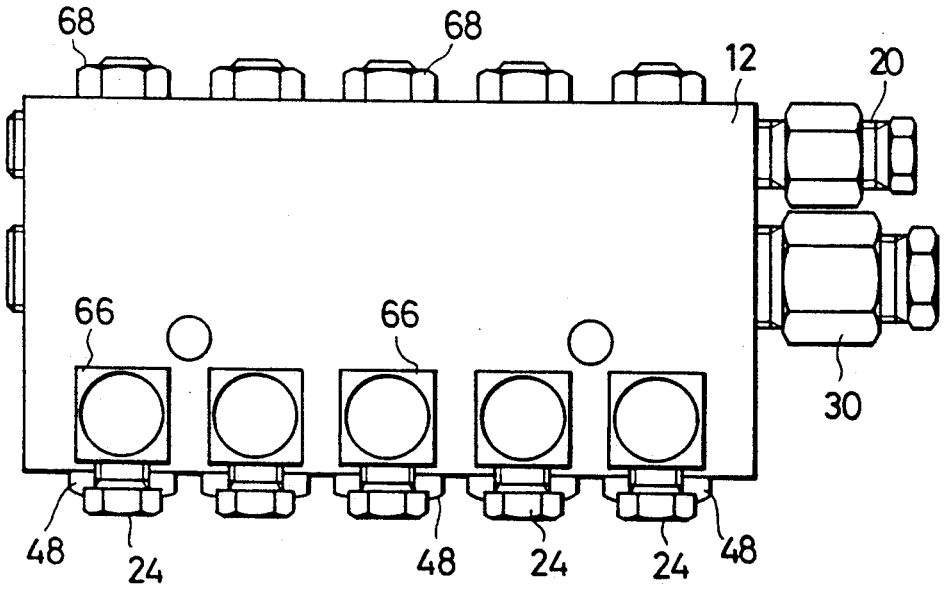
FIG. 3 is a plan view of the lubricating distributor shown in FIG. 1.
Figure 4:
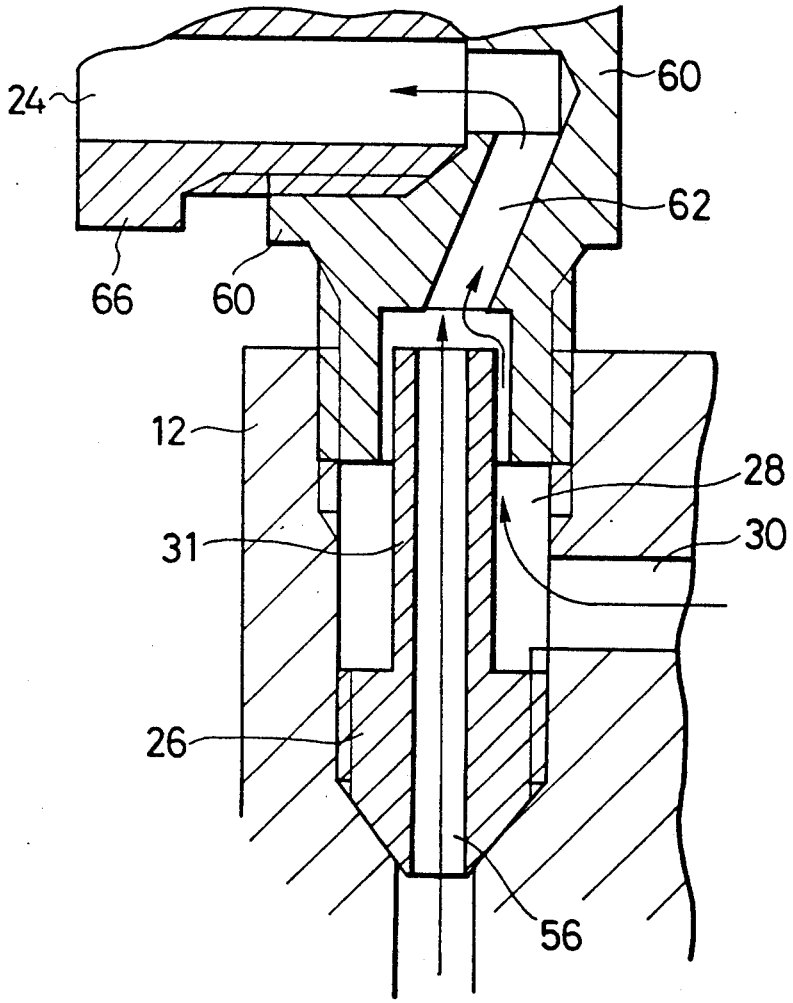
FIG. 4 is a fragmentary enlarged vertical sectional view showing an oil/air mixing section of the lubricating distributor shown in FIG. 1.
Figure 5:
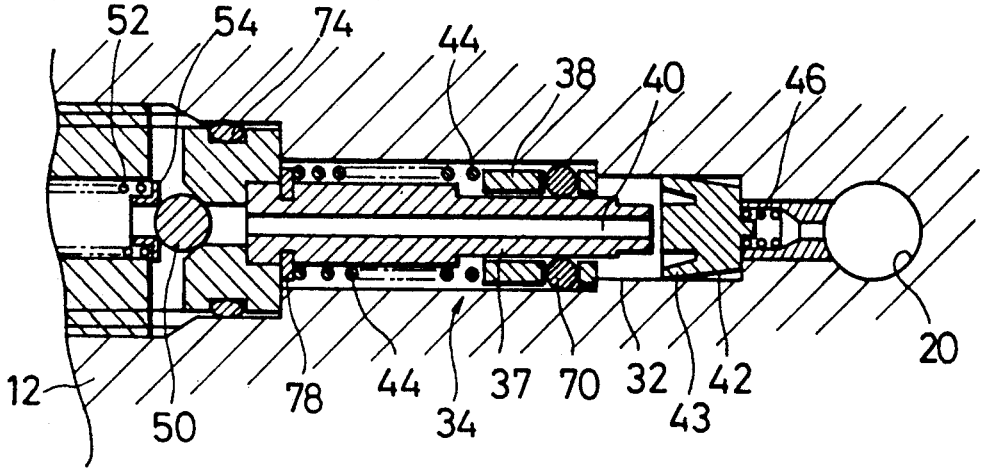
FIG. 5 is a fragmentary enlarged sectional side elevation view showing an oil feed valve of the lubricating distributor shown in FIG. 1.
Figure 6:
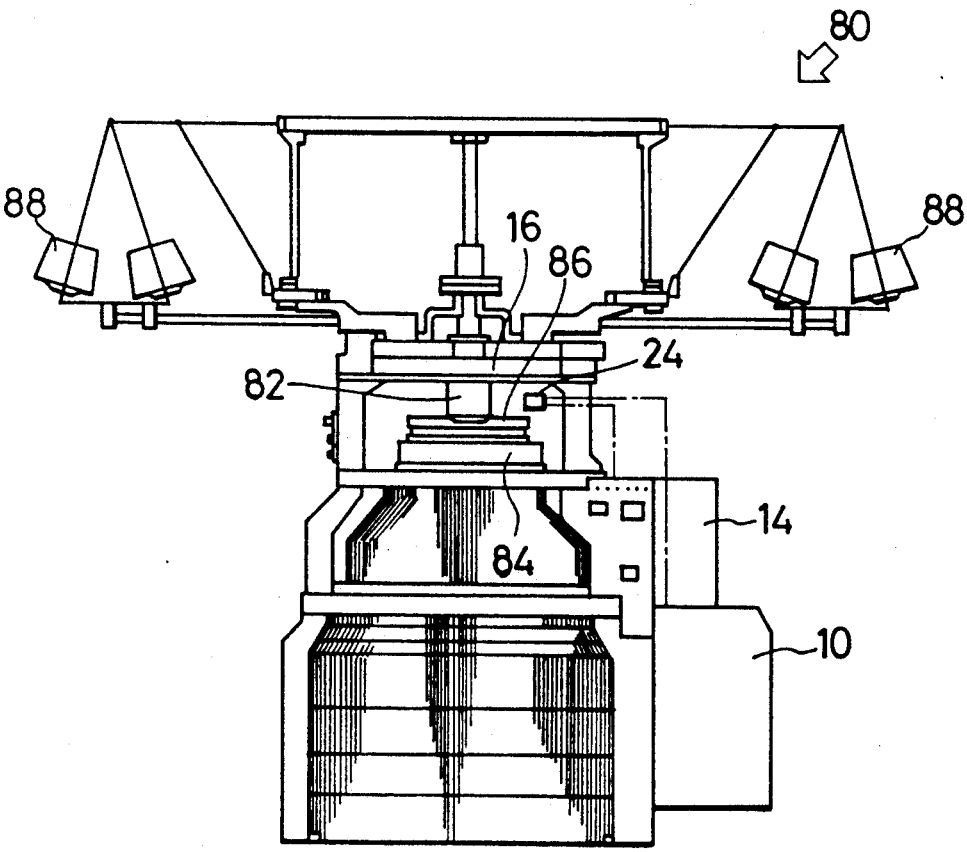
FIG. 6 is a side elevation view showing the manner of use of the lubricating device shown in FIG. 1.

Now, a lubricating device for a knitting machine according to the present invention will be described hereinafter with reference to the accompanying drawings.

FIGS. 1 to 6 illustrate an embodiment of a lubricating device for a knitting machine according to the present invention. A lubricating device of the illustrated embodiment is adapted to introduce compressed air from a compressed air source 10 such as an air pump, a compressor or the like to a lubricating distributor 12 to permit lubricating oil fed thereto from an oil pump 14 to be fed to a lubricated section 16 (FIG. 6) of a circular knitting machine while carrying it on the compressed air. For this purpose, the lubricating device of the illustrated embodiment is so constructed that the lubricating distributor 12 is provided therein with at least one oil passage 18, which includes an oil inlet means 20 connected to an oil path 22 communicating with the oil pump 14 and an oil outlet means 24. In the illustrated embodiment, five such oil passages 18 are formed in the lubricating distributor 12 and correspondingly the outlet means 24 comprises five outlets. The inlet means 20 comprises one inlet. The lubricating distributor 12 is also provided with a throttle nozzle 26 in a manner to be positioned on the way of each of the oil passages 18. The throttle nozzle 26 may be mounted in the distributor 12 by means of screws. Further, the lubricating distributor 12 includes compressed air blowout sections 28 arranged corresponding to the oil passages 18 so as to permit compressed air to be jetted from each of air passages 30 defined in the lubricating distributor 12 so as to communicate with each of the compressed air blowout sections 28. In the illustrated embodiment, the compressed air blowout sections 28 each are formed by reducing a part of the outer diameter of the throttle nozzle 26 as indicated at reference numeral 31 in FIG. 1. The oil passages 18 each include a cylinder or cylindrical space 32, and the cylindrical spaces 32 and the air passage 30 are provided therein with oil feed valves 34 and air feed valves 36, respectively.

The oil feed valve 34 arranged in the cylinder 32 comprises a hollow shaft 37 formed with an axially extending through-hole 40 and stationarily arranged in the cylindrical space 32, a hollow piston 38 slidably fitted on the hollow shaft 37 and an elastic check valve member 42 provided with a peripheral lip 43 and arranged for operating one end of the through-hole 40 of the hollow shaft 37. In the illustrated embodiment, the hollow piston 38 is constantly urged toward the check valve member 42 by means of a spring 44 and the check valve member 42 is arranged between the hollow piston 38 and the oil outlet 20. Also, the elastic check valve member 42 is normally forced against the through-hole 40 of the hollow shaft 37 by means of a spring 46, so that the through-hole 40 is normally closed by the valve member 42. In addition, the check valve member 42, when the peripheral lip 43 is enlarged, contacts with the inner surface of the cylindrical space 32 to block the communication between the inlet means 20 and the outlet means 24. In the illustrated embodiment, the elastic check valve member 42 may be made of a suitable elastic material such as rubber or the like. The lubricating distributor 12 is also provided with a nipple 48 corresponding to each of the oil feed valves 34, which, in the illustrated embodiment, is mounted on the distributor 12 by means of screws. The nipples 48 each include a ball valve 50 elastically forced against the other end of through-hole 40. In the illustrated embodiment, a combination of a spring 52 and a receiving seat 54 is arranged for forcing the valve 50 against the through-hole 40.

When the oil pump 14 is started to guide lubricating oil of a high pressure to the oil inlet 20, the lip 43 of the check valve member 42 is deflated while the valve closes the one or inlet end of the through-hole 40. This results in a gap being circumferentially defined between the inner surface of the cylinder 32 and the valve member 42, through which lubricating oil flows toward the piston 38 to force the piston 38 against- the spring 44. thus the spring 44 is compressed against the washer 78 as can be appreciated from the embodiment of the present invention shown in FIGS. 1 and 5, to thereby cause lubricating oil in a predetermined amount to be accumulated between the piston 38 and the check valve member 42. Then, when the oil pump 14 is stopped to reduce a pressure in the inlet 20, the spring 44 returns the hollow piston 38 toward its original position, so that the accumulated lubricating oil is pressurized to force the check valve member 42 in the right direction in FIGS. 1 and 5. This causes the lip 43 to be expanded to exhibit a sealing action and the check valve member 42 to be moved apart from the hollow shaft 37 to open the through-hole 40, so that the accumulated lubricating oil may enter the through-hole 40 to open the ball valve 50 and then be fed to the throttle nozzle 26. Thus, it will be noted that the oil feed valves 38 each function to intermittently and gradually feed a predetermined amount of lubricating oil to the throttle nozzle 26 every time when the supply of oil to the inlet 20 is intermittently carried out by means of the pump 14. The feed rate of the oil may be controlled by positionally adjusting each of the nipples 48.

The throttle nozzles 26 each are formed with an axially extending through-hole 56 and correspondingly the nipple 48 is formed with a port 58, through which the through-hole 56 of the throttle nozzle 26 communicates with the ball valve 50.

The throttle nozzle 26 is threadedly arranged in the lubricating distributor 12 so that the central through-hole 56 of the nozzle 26 communicates with the port 58 of the nipple 48 to permit lubricating oil to be guided to the throttle nozzle 26. To each of the throttle nozzles 26 is connected a joint 60 so as to communicate therewith. The joint 60 is provided therein with an oil/air mixing section 62, in which compressed air jetted from the air passage 30 to the compressed air blowout section 28 and lubricating oil jetted from the through-hole 56 are mixed to prepare an oil/air mixture, which is then discharged through the outlet 40. In the illustrated embodiment, the outlets 24 each may be provided at a discharge nipple 66 connected to each of the joints 60. In the illustrated embodiment, the air feed valves 36 arranged in the air passage 30 each comprise a needle valve which is threadedly inserted in the air passage 30 through a threaded member 68 so as to be axially movable in the passage 30, resulting in feeding air to the oil/air mixing section 62 while, if desired, controlling or adjusting the flow rate of the air. In the illustrated embodiment, the air passage 30 is branched at the intermediate portion thereof into a plurality of passage sections 69 each connected to each of the compressed air blowout sections 28, and the air feed valve 36 is arranged in each of the passage sections, as shown in FIG. 1. The air feed valve 36 may be set so as to carry out the feed of air also when the feed of lubricating oil is not carried out, to thereby exhibit a function of cooling the lubricating distributor 12 and therefore the lubricating device of the illustrated embodiment.

In the drawings, reference numerals 70 and 72 (FIG. 1) each designate an 0-ring, 74 and 76 each are a seal element, 78 is a washer, 80 (FIG. 6) is a circular knitting machine, 82 is a revolving shaft, 84 is a needle cylinder, 86 is multi-feeder section, and 88 is a bobbin. Reference numeral 90 (FIG. 1) is a through-hole formed at the front portion of the air feed valve 36 so as to axially extend therethrough.

Now, the manner of operation of the lubricating device of the illustrated embodiment will be described in connection with lubrication with respect to the needle cylinder 84 of the circular knitting machine 80 or the like.

Compressed air is fed from the compressor 10 through the air passage 30 to each of the air feed valves 36 and concurrently lubricating oil is fed from the oil pump 14 through the oil path 22 and oil inlet 20 to the oil feed valve 34 in each of the cylinders 32. Subsequently, the compressed air and lubricating oil are fed in amounts predetermined by the valves 34 and 36 to the compressed air blowout section 28 and the throttle nozzle 26 and then mixed together in the oil/air mixing section 62, so that the lubricating oil is fed to and then discharged from the outlet means 24 for lubrication while being carried on the compressed air.

In the illustrated embodiment, the oil feed valve 34 and air feed valve 36 may be adjusted or controlled through the nipple 48 and threaded member 68 so as to vary the flow rate of lubricating oil and that of compressed air, respectively, so that a mixing ratio between compressed air and lubricating oil may be varied as desired. For example, the flow rate of lubricating oil may be varied within the range between 0.01 ml and 0.5 ml for every shot. Also, the lubricating device of the illustrated embodiment may be constructed so as to permit lubrication to be carried out with respect to eight to twenty lubricated sections including a cylinder needle butt, a dial needle butt, a knitting needle latch, a dial, a needle cylinder and the like.

As can be seen from the foregoing, the lubricating device of the present invention is so constructed that the throttle nozzle means is arranged in the oil passage means including the oil inlet means communicating with the oil pump and the oil outlet means, the compressed air blowout section is defined around the throttle nozzle means and the air passage means is arranged so as to communicate with the compressed air blowout section. Also, the oil feed valve means and air feed valve means are arranged in the oil passage means and air passage means, respectively. Such construction of the present invention permits lubricating oil to be outwardly discharged while being carried on compressed air and the necessity of forming lubricating oil into mist to be eliminated, resulting in lubrication to be carried out with high efficient and without polluting a knitting machine. Also, the present invention eliminates uselessness of lubricating oil to a degree sufficient to accomplish economical lubrication while ensuring stable lubrication. Further, the present invention ensures stable operation of a knitting machine at a high speed and reduces maintenance of the lubricating device and therefore the knitting machine.

While a preferred embodiment of the present invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A lubricating distributor for providing a supply of a lubricating oil in a stream of compressed air, said lubricating distributor including lubricating oil feed means for providing a predetermined amount of said lubricating oil, said lubricating oil feed means comprising oil passage means for feeding said predetermined amount of said lubricating oil to said mixing means, said oil passage means including oil feed valve means for feeding said lubricating oil to said oil passage means in said predetermined amounts, said oil feed valve means comprising a hollow shaft including an axially extending through-hole therein, slidable piston means on the outer surface of said hollow shaft, and slidable along said outer surface of said hollow shaft between said shaft and said oil passage means, and elastic check valve means for opening and closing said through-hole in said hollow shaft, compressed air feed means for providing a predetermined amount of said compressed air, and mixing means for mixing said predetermined amount of said lubricating oil with said predetermined amount of said compressed air.

2. The lubricating distributor of claim 1 wherein said lubricating oil feed means includes an oil pump.

3. The lubricating distributor of claim 1 wherein said lubricating oil feed means comprises lubricating oil adjustment means for adjusting said predetermined amount of said lubricating oil provided by said lubricating oil feed means.

4. The lubricating distributor of claim 3 wherein said compressed air feed means comprises compressed air adjustment means for adjusting said predetermined amount of said compressed air provided by said compressed air feed means.

5. The lubricating distributor of claim 1 wherein said lubricating oil feed means comprises intermittent lubricating oil feed means for intermittently feeding said predetermined amount of said lubricating oil.

6. The lubricating distributor of claim 1 wherein said compressed air feed means comprises compressed air passage means for feeding said predetermined amount of said compressed air to said fixing means, said compressed air passage means including compressed air feed valve means for feeding said compressed air to said compressed air passage means in said predetermined amount.

7. The lubricating distributor of claim 6 wherein said oil passage means includes a throttle nozzle for discharging said lubricating oil into said mixing means, and wherein said compressed air passage means includes a blowout section surrounding said throttle nozzle for blowing out said compressed air and discharging said compressed air into said mixing means.

8. The lubricating distributor of claim 1 wherein said elastic check valve means includes a flexible outer lip normally in contact with said oil passage means and flexibly movable out of contact with said oil passage means.

9. The lubricating distributor for feeding a supply of a lubricating oil and a stream of compressed air into the lubricated section of a knitting machine, said lubricating distributor including lubricating oil feed means for providing a predetermined amount of said lubricating oil, said lubricating oil feed means comprising oil passage means for feeding said predetermined amount of said lubricating oil to said mixing means, said oil passage means including oil feed valve means for feeding said lubricating oil to said oil passage means in said predetermined amounts, said oil feed valve means comprising a hollow shaft including an axially extending through-hole therein, slidable piston means on the outer surface of said hollow shaft between said shaft and said oil passage means, and elastic check valve means for opening and closing said through-hole in said hollows shaft, compressed air feed means for providing a predetermined amount of said compressed air, and mixing means for mixing said predetermined amount of said lubricating oil with said predetermined amount of said compressed air.

10. The lubricating distributor of claim 9 wherein said lubricating oil feed means includes an oil pump.

11. The lubricating distributor of claim 9 wherein said lubricating oil feed means comprises lubricating oil adjustment means for adjusting said predetermined amount of said lubricating oil provided by said lubricating oil feed means.

12. The lubricating distributor of claim 11 wherein said compressed air feed means comprises compressed air adjustment means for adjusting said predetermined amount of said compressed air provided by said compressed air feed means.

13. The lubricating distributor of claim 9 wherein said lubricating oil feed means comprises intermittent lubricating oil feed means for intermittently providing said predetermined amount of said lubricating oil.

14. The lubricating distributor of claim 9 wherein said compressed air feed means comprises compressed air passage means for feeding said predetermined amount of said compressed air to said mixing means, said compressed air passage means including compressed air feed valve means for feeding said compressed air to said compressed air passage means in said predetermined amount.

15. The lubricating distributor of claim 14 wherein said oil passage means including a throttle for discharging said lubricating oil into said mixing means, and wherein said compressed air passage means includes a blowout section surrounding said throttle nozzle for blowing out said compressed air and discharging said compressed air into said mixing means.

16. The lubricating distributor of claim 9 wherein said elastic check valve means includes a flexible outer lip normally in contact with said oil passage means and flexibly movable out of contact with said oil passage means.

* * * * *

UNITED STATES PATENT AND TRADEMARK OFFICE

CERTIFICATE OF CORRECTION

PATENT NO. : 5,154,259

DATED : October 13, 1992

INVENTOR(S) : Magome

It is certified that error appears in the above-identified patent and that said Letters Patent is hereby corrected as shown below:

Column 7, line 52, delete "fixing" and insert therefor --mixing--.

Column 8, line 6, delete "The" and insert therefor --A--.

Column 8, line 19, after "shaft" (first occurrence), insert --and slidable along said outer surface of said hollow shaft--.

Signed and Sealed this

Ninth Day of November, 1993

Bruce Lehman

*Attest:*

BRUCE LEHMAN

*Attesting Officer*

*Commissioner of Patents and Trademarks*